US006834609B2

(12) United States Patent
Cannon, Jr.

(10) Patent No.: US 6,834,609 B2
(45) Date of Patent: Dec. 28, 2004

(54) BOAT RACK

(76) Inventor: Ray Allen Cannon, Jr., 6080 Mosely Ave., Clinton, NC (US) 28328

( * ) Notice: Subject to any disclaimer, the term of this patent is extended or adjusted under 35 U.S.C. 154(b) by 0 days.

(21) Appl. No.: 10/292,582

(22) Filed: Nov. 13, 2002

(65) Prior Publication Data

US 2004/0089218 A1 May 13, 2004

(51) Int. Cl.[7] ..... B63B 17/00
(52) U.S. Cl. ..... 114/364; 114/343
(58) Field of Search ..... 114/343, 364; 224/400, 406, 545, 547, 558, 553, 564, 565, 566

(56) References Cited

U.S. PATENT DOCUMENTS

| | | | | | |
|---|---|---|---|---|---|
| 2,592,011 | A | * | 4/1952 | Colston | 114/361 |
| 2,729,016 | A | * | 1/1956 | McDaniel | 43/55 |
| 2,795,889 | A | * | 6/1957 | Garland | 43/55 |
| 3,668,739 | A | * | 6/1972 | Lewis | 452/194 |
| 4,858,796 | A | * | 8/1989 | Roth | 224/482 |

* cited by examiner

*Primary Examiner*—Sherman Basinger
(74) *Attorney, Agent, or Firm*—John B. Dickman III

(57) ABSTRACT

A pivotally mounted rack removably attached to the hull of a boat and adapted to be rotated to various positions inside and outside the boat hull as desired.

3 Claims, 4 Drawing Sheets

BOAT RACK

BACKGROUND OF THE INVENTION

This invention relates to smaller boats having limited storage space and a device for overcoming this storage of space. The present invention provides boaters with a rack for carrying articles that would otherwise have to be left behind or crowded into the boat. The rack is supported on the outside of the boat hull. Heretofore, racks have been used for purposes such as net holders on trawlers, as in U.S. Pat. No. 3,805,722 to Melchert et al. A minnow box is shown in U.S. Pat. No. 2,721,718 to Wagner, which is mounted on the gunwales of a boat and in U.S. Pat. No. 5,165,645 to Brown an exterior cooler holder is shown mounted on the rear of a vehicle. The problem with having a rack mounted on the outside of a hull is the danger of smashing into a dock, another boat or a piling. The aforementioned patents show different mounting brackets of interest to the present invention. In Melchert et al, the rack and the rod pivot in a pair of brackets on the hull. Melchert et al also shows a pair of rails on the rack below the brackets to rest against the hull. A similar pair of rails is shown in Victor, in which the rails have holes to adjust the angle of the platform.

It is a primary object of the invention to provide a rack for mounting to the outside of a boat hull which is removably attached to the hull with any permanent attachment. To accomplish this, a special type bracket forms part of the invention. The bracket conforms to the shape of the gunwales where part of the bracket presses against the exterior hull and over the gunwale. A tightening screw is threaded to an interior portion of the bracket such that it can tighten against the inside of the hull.

Another object of the invention is to provide a rack and mounting bracket where the rack is adjustable to raise or lower the free end of the rack to prevent articles from sliding off the rack into the water. One way in which the invention raises or lowers the free end of the rack is a tightening screw threaded into the rack and has a pad for resting either against the mounting bracket or against the hull. It is important to realize that neither the rack nor bracket is permanently attached to the hull.

Still another object is to provide a rack that is mounted on the outside of the hull and can in a moment's notice pivot into the boat to avoid possible damage.

Other objects and advantages of the invention will become apparent from a study of the following specification when viewed in light of the accompanying drawings, in which.

DESCRIPTION OF THE INVENTION

Figure 2:
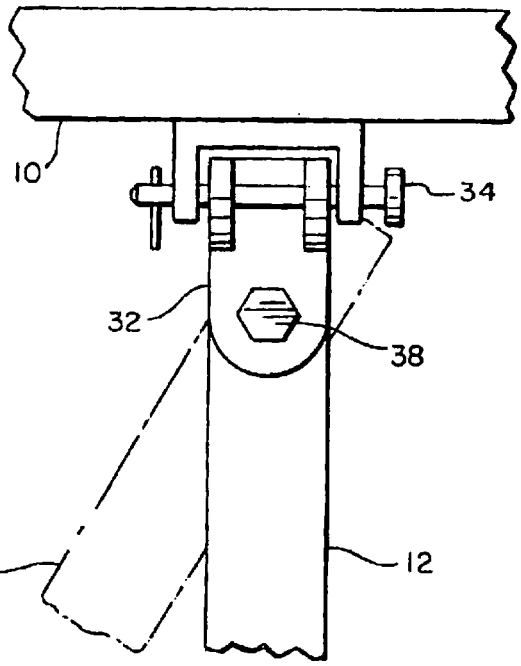
FIG. 2 shows a top view of FIG. 1 taken along the line 2—2 of FIG. 1.
Figure 3:
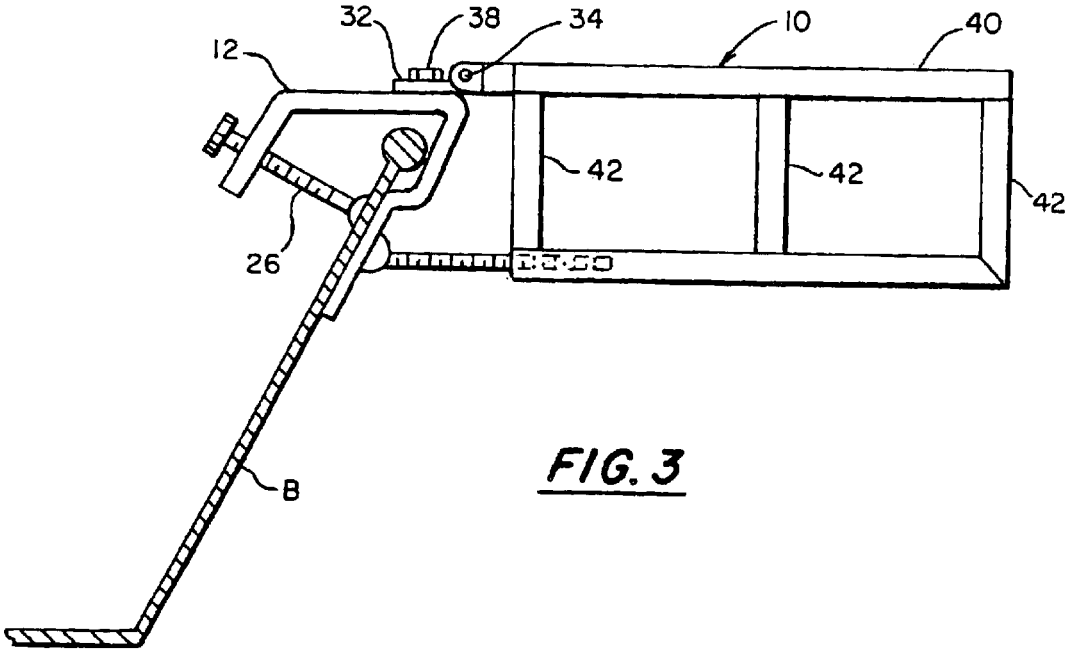
FIG. 3 shows another embodiment of the inventions, showing a bracket of FIG. 1 and a rack with a free end adjustment.
Figure 4:
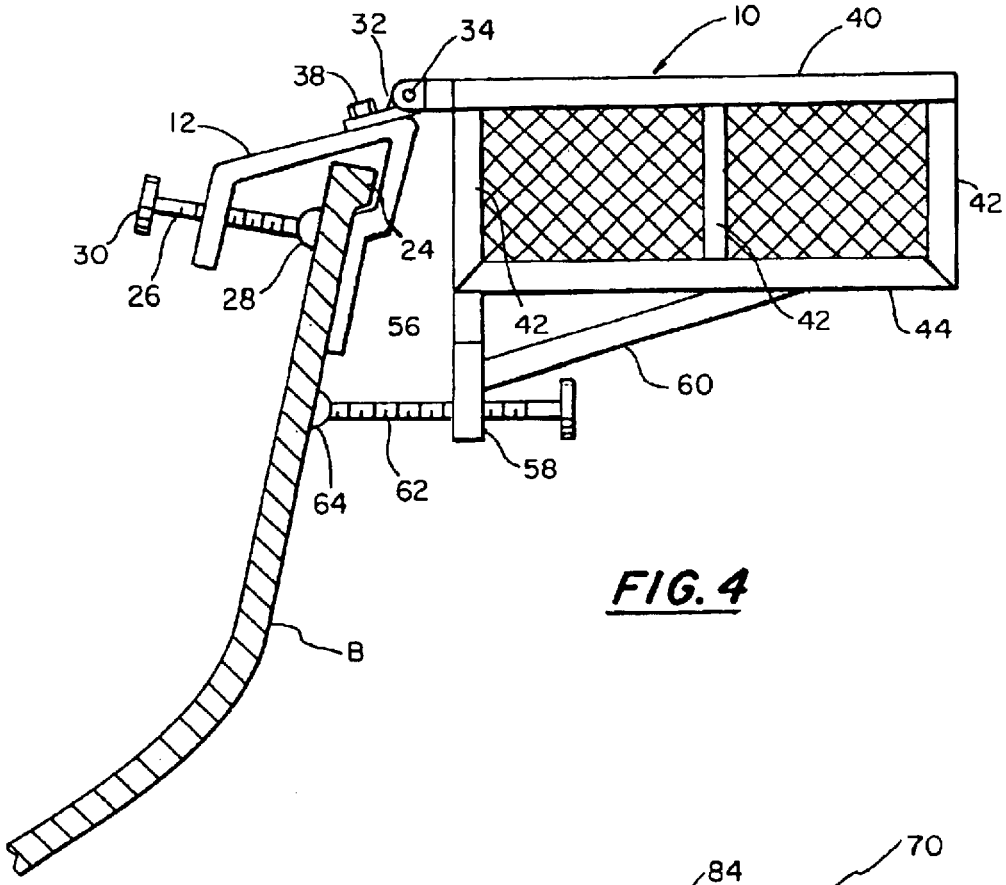
FIG. 4 shows another embodiment of the free end adjustment of FIG. 3.

Referring to the drawings, FIGS. 1-6 (7), there is shown a removable rack for mounting on the outside of a boat hull. FIG. 4 (7) shows a small boat hull B with a rack 10 mounted on the outside of hull B. The rack 10 is used to hold articles that would normally over-crowd the boat. A pair of brackets 12 is clamped to the boat hull B, and pivotally connects to rack 10. The capability to pivot the rack 10 can prevent damage to the rack 10 when nearing the docks, pilings or another boat.

Figure 1:
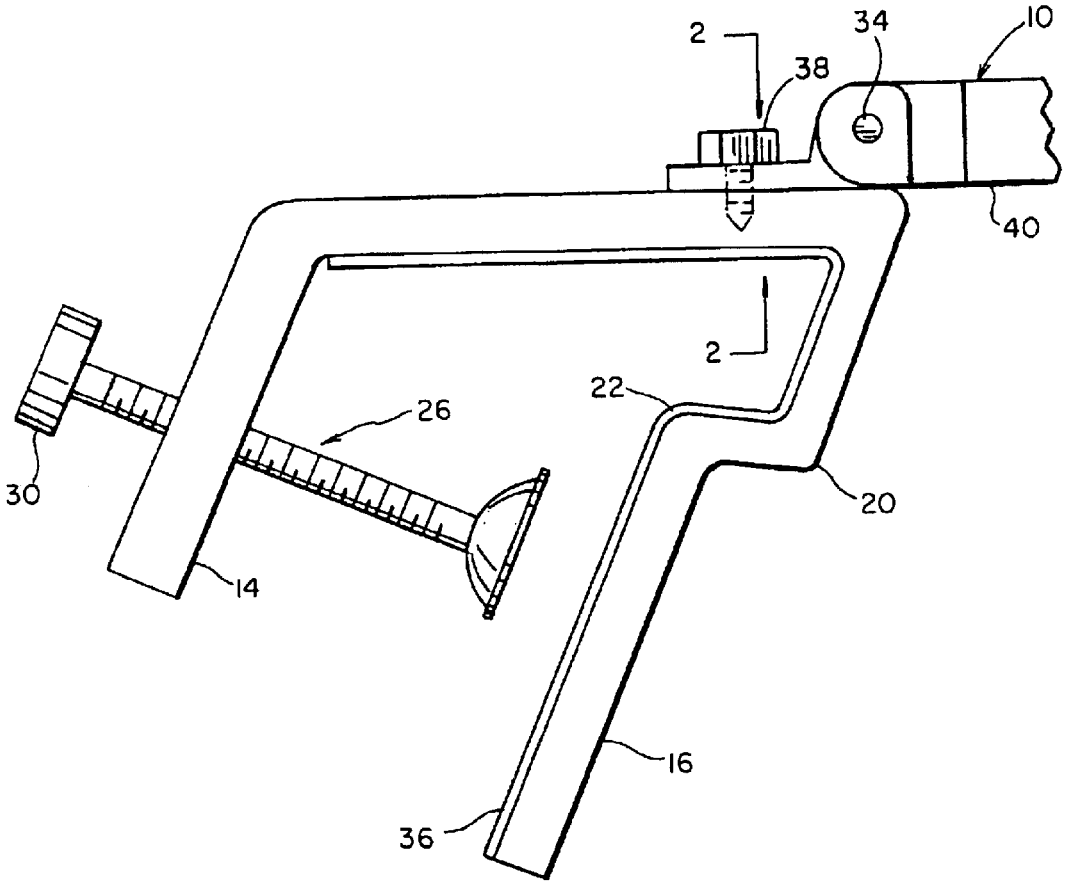
FIG. 1 shows a bracket of the present invention having a pivoting element for attaching to a rack of the invention.

FIG. 1 shows a bracket 12 of the invention having a pair of integral legs 14 and 16 parallel to one another. Each leg 14 and 16 are integrally connected to top cross member 18. Leg 16 has a pair of bends 20 and 22 for fitting the leg over a gunwale of boat B. The upper portion of leg 16 will extend past a gunwale 24, as shown in FIG. 4, where leg bends at 20 toward leg 14. The leg 16 extends inward to cover the gunwale 24 and then bends at 20 to again extend parallel to leg 14. Bracket 12 is slid over the side of the hull of boat B, where a threaded screw 26 with a swivel pad 28 is tightened by a knob 30 on the screw 26. Threaded screw 26 is inserted in a threaded hole (not shown) in leg 14 such that tightening the screw 26 draws leg 16 to the outside of the hull. Member 18 rest on the top of the gunwale 24 giving support to the bracket 12. A rack 10 is connected by hinges 32 to a pair of brackets 12 so that the rack 10 is supported by the brackets 12 on the outside of the boat B. A hinge pin 34 allows the rack 10 to be pivoted into the boat whenever it becomes necessary. To protect the hull of boat B, the bracket 12 is lined with a protective material 36, such as rubber.

Hinge 32, as shown in FIGS. 1 and 2 are bolted to bracket 12 by a bolt 38. FIG. 2 shows the rack 10 pivoting horizontally to adjust the position of the rack 10 on the side of the boat B. Bracket 12' represents bracket 12 after adjusting the position of the rack 10.

Figure 7:
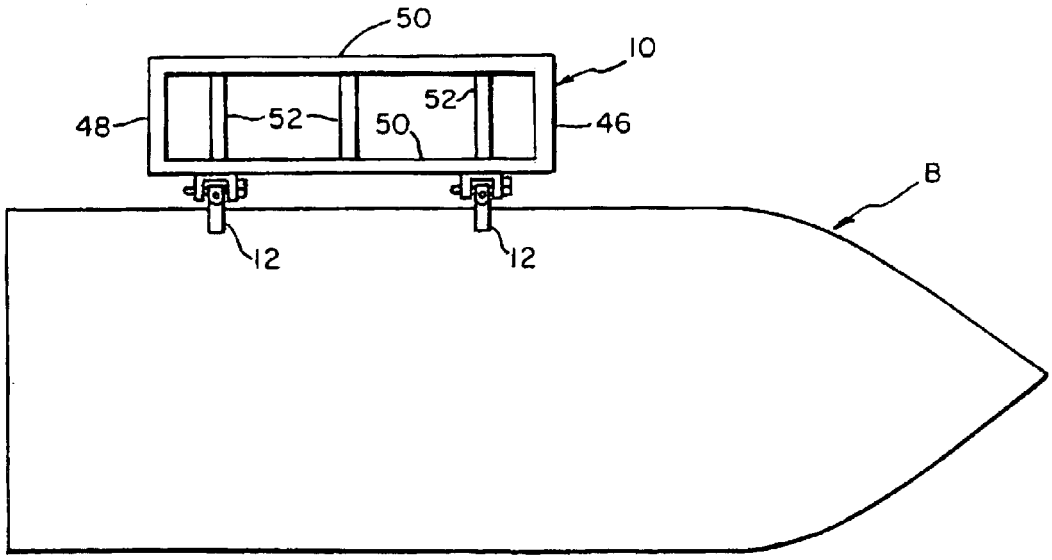
FIG. 7 shows a top view of a rack of the back of the invention mounted on the outside of a boat, the outline of the boat is shown.

In FIG. 3, a rack 10 is shown for use on boats which have deeper hulls; therefor, the rack 10 has a top rail 40 level with the top of bracket 12. Rack 10, as stated, has a top rail 40 to which is welded to vertical posts 42. A bottom rail 44 completes each of a pair of sides 46 and 48 of FIG. 7. A pair of top rails 50, which are longer than top rails 40, and a similar pair of longer rails form bottom rails which are welded to bottom rails 44. Vertical posts, not shown, similar to posts 42 are welded to top rails 50 and bottom rail, not shown. There are horizontal posts 52, which form the bottom of rack 10.

The rack 10, in FIG. 4, is shown with cage-like side walls 54 welded to the rails and posts. The boat hull B has more vertical side walls and the bracket 12 adjusts to the new slope by raising the height of the rack above the gunwale 24. To aid in the support of rack 10, an additional supporting bracket 56, is welded to the bottom of the rack 10, forming a second embodiment of the invention. Bracket 56 has a vertical support 58 and a supporting arm 60 where it is welded at an angle between post 58 and the bottom of the rack. A threaded screw 62, similar to screw 26, has a pad 64 for engaging the hull. Tightening the screw 62 adjusts the rack upwardly, while loosening the screw lowers the rack.

Figure 5:
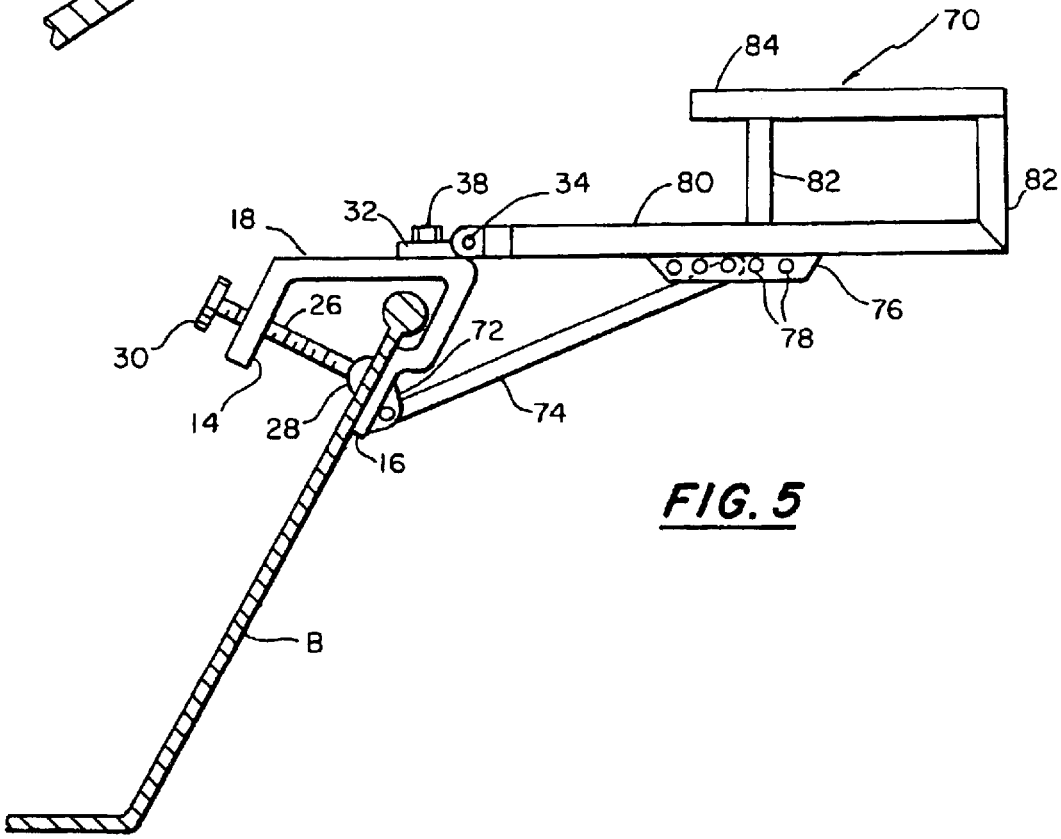
FIG. 5 shows still another embodiment of the invention where the free end adjustment is a pivotal rod attached to the bracket and adjustably mounted to the rack.
Figure 6:
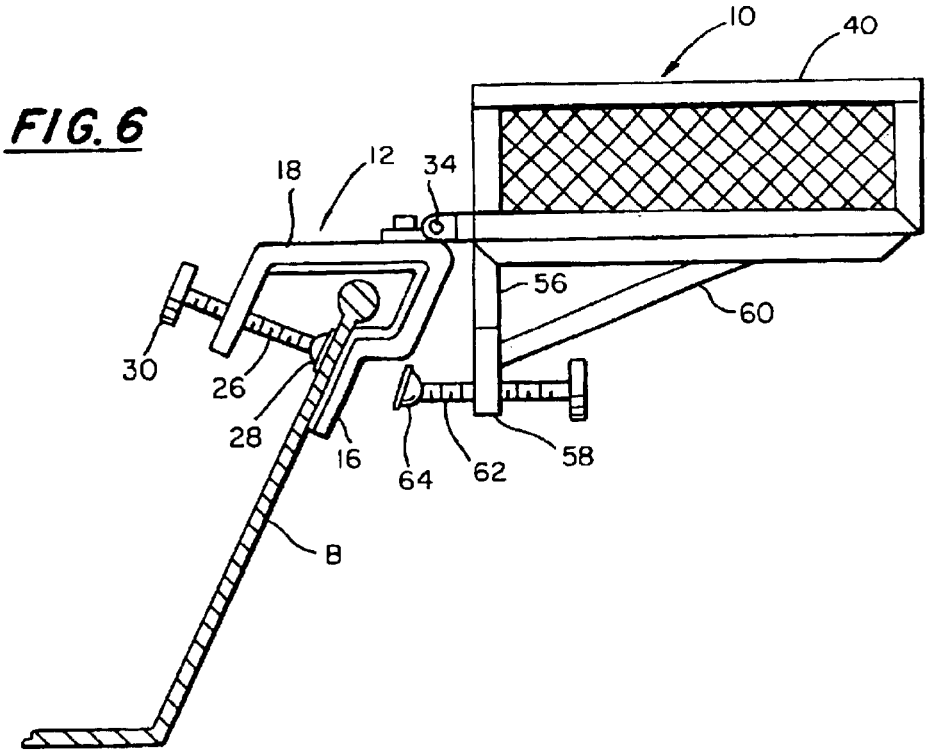
FIG. 6 shows another embodiment of the invention.

An embodiment of the invention is shown in FIG. 5 where the rack 70 is used in boats with lower height hulls such as Jon. Rack 70 is supported on the hull of boat B by a bracket 12, similar to the bracket in FIG. 1. Leg 16 has a pivot 72 welded to it which connects a pivot arm 74 to the bracket 12 and to rack 70 raising or lowering member 76 on the bottom of rack 70. Member 76 has a plurality of holes 78 for connecting to the pivot arm 74, thereby, adjusting the height of the rack. The rack 70 has lower rails 80 with vertical posts 82 and upper rails 84. The upper rails 84 are somewhat shorter than lower rail 80.

The use of a rack of the invention, no matter which embodiment used, provides boats with little or no space for storage, a removable space on the outside of the boat hull. Generally the type of boat that needs external storage space would be smaller open fishing boats of less than 24 feet in length. This type of boat has a hull, which rises a foot and a half to maybe two feet from the water; in other words, the boat has a small area in which people, fishing gear, coolers, etc. can fit. The rack of the invention removes some of the space problems. The brackets 12 of the invention are usable with each of the embodiments of the rack in FIGS. 3, 4 and 5. With a rack 10 or 70 pivotally connected to the brackets 12 by hinges 32 and pins 34, the brackets 12 are inserted over the gunwales of the hull to the place where the leg 16 with its bends to accommodate the gunwale which presses against the outside of the hull. Threaded screw 26 tightens leg 16 against the hull by pressing its pad 28 against the inside of the hull, as shown in FIGS. 3-5.

Most boat hulls have a continuous curve from the bow to the stern. FIG. 2 shows adjusting the rack to fit against the hull. The hinge 32 allows the rack to move horizontally by loosening bolt 38 and sliding the bracket 12 to adjust the distance between the rack and the hull, as shown by the dashed line 12.

In order to pivot the rack into the boat the hinge 32 and the rack are pivotally connected by a pin 34, FIGS. 2, 3, 4 and 5. The only rack, which will not pivot freely, is FIG. 5 where pivot arm has to be released at pivot 72 or lower member 74.

While several embodiments have been disclosed, it should be understood that other embodiments may be realized from studying the drawings, disclosure and claims.

What is claimed:

1. A combination bracket and rack for supporting articles on the outside of a boat hull, comprising;

a pair of brackets with a first leg and a second leg connected by an integral top member, where the bracket extends over the inside and outside of the hull with the top member extending over the hull's gunwale;

said first leg extends over the outside of the gunwale and presses against the outside of the hull;

said second leg extends on the inside of the hull and has a screw threaded tightening means which extends through a threaded aperture in said second leg to press a hull contact pad on said screw threaded tightening means against the inside of the hull; and, a hinge means on said integral top member for pivotally connecting a rack to said brackets, where said rack is pivotal from the hull to the inside of the hull, said pair of brackets mounted on hulls having different heights from the waterline and having different hull angles, said first legs having a bend to wrap around the gunwales on the outside of the hull, said rack has an open receptacle shape constructed of top and bottom rails supported by vertical posta where said rack is covered with an open mesh material where said rack has an adjustment means to raise and lower the free end of said rack with a supporting means extending below said rack to support said adjustment means in a position to contact the hull.

2. A combination bracket and rack as in claim 1 wherein said rack has an open receptacle shape constructed of top and bottom rails supported by vertical posts, where said top rails connect to said hinge to support said rack at the same height as the top surface of the hull.

3. A combination bracket and rack as in claim 1 wherein said rack has an open receptacle shape constructed of top and bottom rails supported by vertical posts where said top and bottom rails connect to said hinge to support said rack at a height above said top surface of the hull.

* * * * *